US006743971B1

(12) United States Patent
Chen

(10) Patent No.: US 6,743,971 B1
(45) Date of Patent: Jun. 1, 2004

(54) ELECTRONIC MUSICAL KEYBOARD OPERATED BY FOOT FOR AMUSEMENT AND EXERCISE

(75) Inventor: Chan-Chuan Chen, Taichung Hsien (TW)

(73) Assignee: Red Tower, Inc., Taichung Hsien (TW)

( * ) Notice: Subject to any disclaimer, the term of this patent is extended or adjusted under 35 U.S.C. 154(b) by 0 days.

(21) Appl. No.: 10/340,823

(22) Filed: Jan. 13, 2003

(51) Int. Cl.[7] ..... G10H 1/32
(52) U.S. Cl. ..... 84/746
(58) Field of Search ..... 84/721, 746

(56) References Cited

U.S. PATENT DOCUMENTS 3,922,944 A * 12/1975 Kurosaki et al. ..... 84/721
4,121,488 A * 10/1978 Akiyama ..... 84/720
4,491,050 A * 1/1985 Franzmann ..... 84/746
5,837,952 A * 11/1998 Oshiro et al. ..... 200/86 R
6,450,886 B1 * 9/2002 Oishi et al. ..... 463/36

* cited by examiner

*Primary Examiner*—Jeffrey W. Donels
(74) *Attorney, Agent, or Firm*—Harrison & Egbert

(57) ABSTRACT

An electronic amusement-exercise device includes a keyboard, an electronic circuit board disposed in the keyboard, and a plurality of keys mounted on the keyboard. As the keys are treaded on by the feet of a person, musical tones are reproduced through a loud speaker which is fastened to the keyboard.

4 Claims, 4 Drawing Sheets

ELECTRONIC MUSICAL KEYBOARD OPERATED BY FOOT FOR AMUSEMENT AND EXERCISE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to an electronic musical keyboard for amusement, and more particularly to an electronic musical keyboard for use as an amusement device as well as an exercise device.

BACKGROUND OF THE INVENTION

The exercise device is generally so monotonous that people get tired of using it easily. For this reason, the exercise device should be so designed that it can be used for dual-purpose amusement and exercise, or that it can be incorporated into an amusement device or vice versa.

BRIEF SUMMARY OF THE INVENTION

The primary objective of the present invention is to provide an electronic musical device which is operated by the foot for amusement and exercise.

In keeping with the principle of the present invention, the foregoing objective of the present invention is attained by an electronic musical keyboard which is operated by the foot and is formed of a keyboard, a plurality of keys, an electronic circuit board, and one or more loud speakers. The electronic musical keyboard of the present invention is operated by the foot in such a way that the tone or sound is reproduced when certain key of the keyboard is trampled on.

The features and the functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
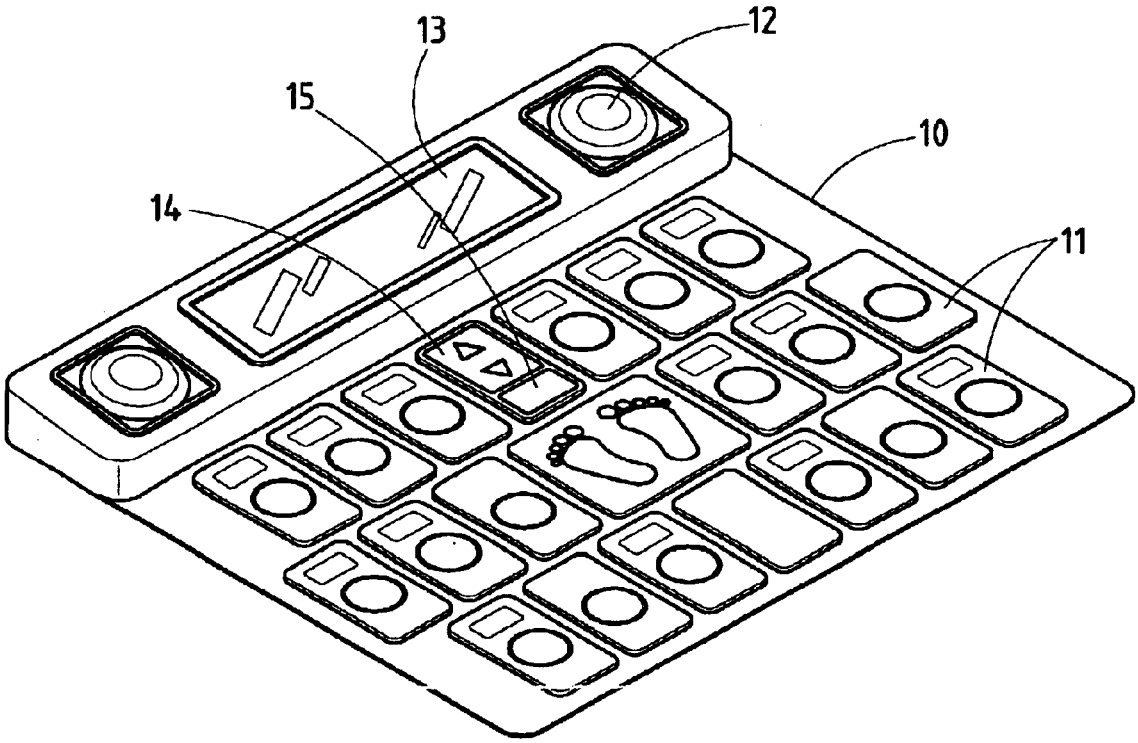
FIG. 1 shows a perspective view of the preferred embodiment of the present invention.
Figure 2:
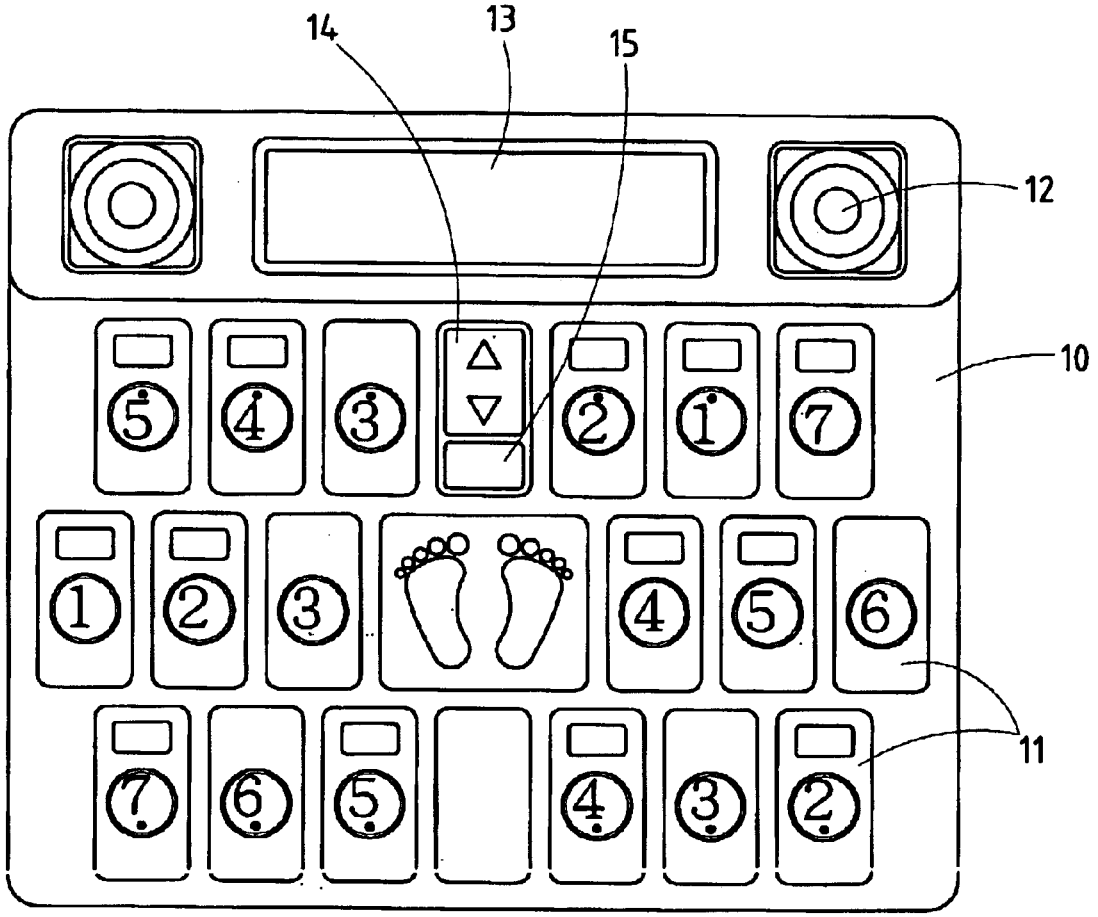
FIG. 2 shows a top plan view of the preferred embodiment of the present invention.

As shown in FIGS. 1–5, an electronic musical device embodied in the present invention is operated by the foot for amusement and exercise. The electronic musical device comprises a foldable keyboard 10, at least one loud speaker 12, and an electronic circuit (not shown in the drawings.)

The foldable keyboard 10 is provided with a plurality of keys 11, which are connected to the electronic circuit. The electronic circuit is disposed in the keyboard 10 and is provided with a programmed musical mode. When the key 11 is treaded on, a tone or sound is reproduced through the loud speaker 12. The device of the present invention is provided with battery which is not shown in the drawings and is used as a power source.

Figure 3:
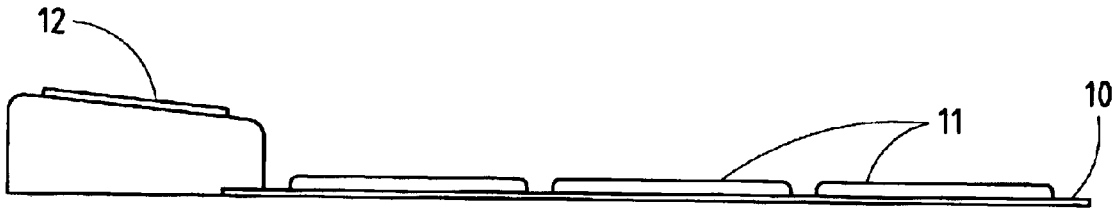
FIG. 3 shows a side plan view of the preferred embodiment of the present invention in an unfolding state.
Figure 4:
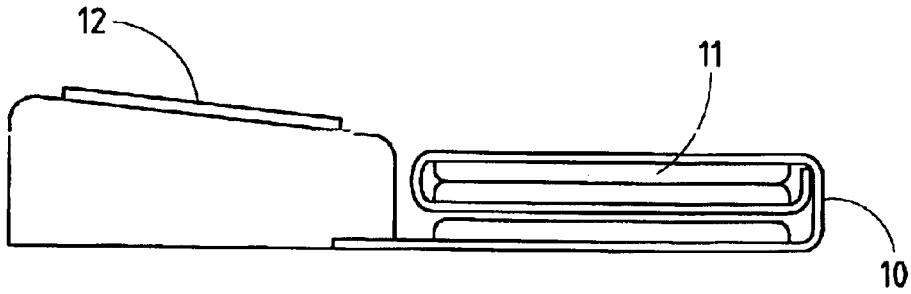
FIG. 4 shows a side plan view of the preferred embodiment of the present invention in a folding state.
Figure 5:
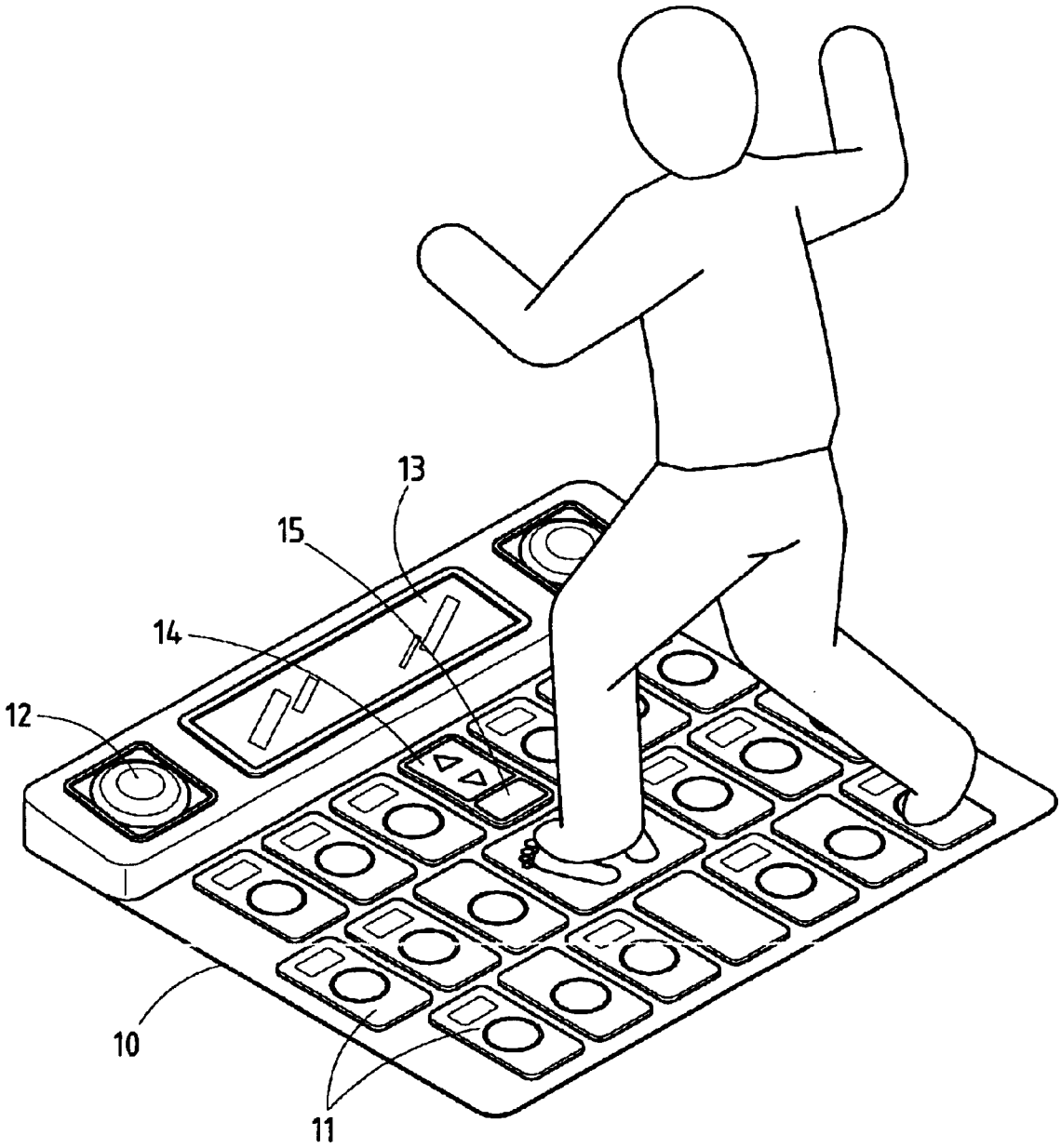
FIG. 5 shows a schematic view of the preferred embodiment of the present invention at work.

The foldable keyboard 10 is made of a plastic material having a softness. The keyboard 10 can be unfolded, as shown in FIG. 3, or folded, as shown in FIG. 4.

The device of the present invention further comprises a control panel 13, which is fastened to the keyboard 10.

The keys 11 are arranged in three rows on the keyboard 10, with the key 14 serving to control the volume and with the key 15 serving as a tone selector. The top row includes other keys for controlling the reproduction of the intermediate tones or the highest tones. The middle row includes keys for controlling the intermediate tones, whereas the bottom row includes keys for controlling the reproduction of the lowest tones. The musical tones are reproduced through the loud speaker 12 when the keys 11 are trampled on by the feet of a user of the device. The user of the device can do the leg exercise by treading on the keys 11. In the meantime, various musical tones are reproduced through the loud speaker 12 to amuse the user of the device.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A dual-purpose amusement device comprising:

a keyboard panel formed of a flexible material, said keyboard panel having a top edge and a bottom edge;

an electronic circuit board positioned in a housing adjacent said top edge of said keyboard panel;

a plurality of keys arranged in generally parallel rows on said keyboard panel, and parallel rows extending between said electronic circuit board and said bottom edge of said keyboard panel, said keyboard panel being foldable between said parallel rows such that the keys of one row overlie the keys of an adjacent row, said plurality of keys being connected to said electronic circuit board so as to control a reproduction of musical tones, said keys positioned so as to be activated by action of human feet; and at least one loudspeaker mounted on said keyboard panel adjacent said top edge and within said housing, the loudspeaker producing an audible tone when the key is activated by the feet.

2. The device of claim 1, on of said plurality of keys being a tone volume controller, said tone volume controller positioned generally centrally along one of the parallel rows.

3. The device of claim 1, one of said plurality of keys being a tone selector, said tone selector positioned generally centrally along one of the parallel rows.

4. The device of claim 1, said keyboard panel being foldable such that all of said parallel rows are folded in stacked relationship upon each other in a position below said housing.

* * * * *